United States Patent [19]

Maurer, Jr. et al.

[11] 4,447,996

[45] May 15, 1984

[54] FACTORY BUILT CONSTRUCTION ASSEMBLY

[76] Inventors: Edward J. Maurer, Jr., P.O. Box 5880, Austin, Tex. 78763; Hanns U. Baumann, 312 Emerald Bay, Laguna Beach, Calif. 92651; Herbert E. Watkins, 7803 Pinegreen La., Humble, Tex. 77338

[21] Appl. No.: 271,802

[22] Filed: Jun. 8, 1981

[51] Int. Cl.[3] ..... E04F 17/08

[52] U.S. Cl. ..... 52/79.1; 52/745

[58] Field of Search ..... 52/79.1, 741, 745

[56] References Cited

U.S. PATENT DOCUMENTS

| | | | |
|---|---|---|---|
| 3,162,863 | 12/1964 | Wokas | 52/79.1 |
| 3,601,937 | 8/1971 | Campbell | 52/79.1 |
| 3,750,366 | 8/1973 | Rich, Jr. et al. | 52/79 |
| 3,778,953 | 12/1973 | Delorean | 52/745 |
| 3,992,848 | 11/1976 | Stucky | 52/79.1 |
| 4,221,441 | 9/1980 | Bain | 52/79.1 |
| 4,327,529 | 5/1982 | Bigelow, Jr. et al. | 52/79.1 |

*Primary Examiner*—Peter M. Caun

*Attorney, Agent, or Firm*—James W. Lucas

[57] ABSTRACT

A prefabricated building cubicle has a portion of the floor recessed to receive an interior bathroom module, which is also prefabricated, and contains plumbing lines and complete fixtures. The building cubicle has plumbing and electrical lines on one wall adapted to connect to the interior module when installed in the floor recess.

The bathroom module can be disconnected and rolled through an openable area in one wall of the cubicle, such as that created by removal of a pair of sliding balcony doors. A new module can then be installed, such as a kitchen module or another bathroom, facilitating upgrading or conversion of hotel rooms to a condominium.

9 Claims, 6 Drawing Figures

FACTORY BUILT CONSTRUCTION ASSEMBLY

BACKGROUND OF THE INVENTION

This invention relates generally to prefabricated building structures, and more particularly to those involving multiple units.

Prior art building units have indicated a trend toward maximum construction completed in the factory, and a minimum at the erection site. Whole rooms can sometimes be completely finished and sealed off for transportation to the site. An example of the degree of completion to be encountered can be found in U.S. Pat. No. 3,750,366 issued Aug. 7, 1973 to Rich et al. The units shown even include their own heating and cooling systems, and have external plumbing connections so the interior of the unit need never be entered prior to occupancy.

This approach saves on final cleanup costs, but becomes a disadvantage once the unit is permanently tied in to the building structure. If plumbing connections are made readily accessible from outside the unit before completion of the building, they will probably be fairly inaccessible from inside the unit after the structure is sealed up. Any future changes for upgrading or conversion to another use become as difficult as if the unit had not been prefabricated.

The lifting crane capacity must also be sufficient to position the entire unit at once. In case of fire or other damage, repairs must be made in the most expensive manner, on the site.

A primary object of the present invention is, therefore, to provide means for facilitating upgrading of a prefabricated building cubicle.

Another object is to allow for easier conversion of a cubicle to another use.

Still another object of my invention is to reduce the work involved in repairing fire damaged units.

A further object is to improve the accessibility of plumbing areas for major repairs or removal of pipes.

A still further object is to allow the use of smaller lifting cranes for positioning prefabricated cubicles in multi-story buildings.

SUMMARY OF THE INVENTION

The present invention discloses a type of construction for prefabricated building cubicles, to accommodate and cooperate with an interior prefabricated module. The interior module will generally be a self-contained bathroom unit, complete with a lavatory, bathtub, water closet and their associated plumbing. Electrical wiring and outlets are also installed, together with an opening for the required ceiling exhaust fan. The module is normally completely enclosed, having four walls, a floor and a ceiling, with the overall height substantially less than that of the building cubicle which accommodates it. One alternate module could be a kitchen unit containing a stove, an oven and a sink, with the associated plumbing and wiring arranged to have interchangeable connections with the above-described bathroom module.

The building cubicle itself has a recessed floor portion to match the size of the module floor, and of corresponding depth to align with the floor of the module when installed. The cubicle has four walls, a floor and a ceiling, with one wall, usually the one to become an outside wall, containing an openable area of sufficient size to allow passage of an interior module through it. In most cases, this area will be opened by removing both panels of a sliding balcony door.

The opposite wall from the above door has all the permanent plumbing and electrical lines adjacent to it, with the plumbing lines adapted for connection with the above-described interior module.

If the available lifting crane is of sufficient capacity to lift it, the prefabricated cubicle is positioned as an assembly, with the interior module already inside. However, they can be lifted separately if the crane is too small to handle their combined weight.

At some time in the future, it may be advisable to upgrade the bathroom module. A completely new unit, possibly one that has been refurbished at the factory, is brought on site, and the old one is removed as follows:

The plumbing lines of the cubicle are disconnected from the module. The module floor has several internally-threaded attachments, into which long bolts are installed and extended, to elevate the floor above the recessed floor of the cubicle. This provides access beneath the module for applying low-profile roller assemblies to its bottom surface. The long bolts are retracted from contact with the cubicle floor, and the sliding doors are removed from the outside wall of the cubicle. The module can now be rolled out of the cubicle floor recess, pushed completely through the open area, and lowered to the ground by the crane.

The new module is installed into the building cubicle as follows:

The module is first pushed partially through the open area, and low-profile roller assemblies are applied to the module bottom surface. It is then pushed completely inside the cubicle and additional roller assemblies are applied. The module is rolled into the recess in the cubicle floor, and long bolts installed and extended through the internally-threaded floor attachments of the module, to further elevate the module floor above the cubicle floor. The roller assemblies can now be removed, and the module lowered into position in the recess by removing the bolts from the threaded attachments. The cubicle plumbing lines are then connected to the module.

The cubicle may have a ventilation fan and exhaust duct adjacent to the ceiling, which remain attached to the cubicle while the module is removed. Sufficient flexibility of attachment allows the module to be installed, aligning an exhaust opening in the module ceiling with the fan, without being impeded by the fan and duct.

After the module is installed in the floor recess of the cubicle, about a nine inch space exists between the ceiling of the module and that of the cubicle. Since the module is probably located in a corner of the cubicle, only two module walls will have a visible gap above them. Flaps can be hinged to the cubicle ceiling, aligned with the two walls and of sufficient height to fill the gap above the module ceiling.

If conversion to a condominium is desired, a typical approach might be to divide the units into adjacent groups of three. One would remain a bathroom, and two would be converted to a kitchen plus living and dining area by removing the wall between, with a floor section added to build the unused recessed portion up to the cubicle floor level.

In order for the kitchen module to reach across the entire cubicle width, a removable floor section is lifted out. Since a common wall between two cubicles is removed to enlarge the room, the module can be turned sidewise to pass thru the open area.

Additional advantages and features of the invention will become apparent as it is described in detail in the following preferred embodiment.

DETAILED DESCRIPTION OF A PREFERRED EMBODIMENT

The present invention relates to cooperating features of a prefabricated building cubicle and an interior module intended for installation therein. The floor of the cubicle has a recessed portion of the proper dimensions to receive a self-contained bathroom module. The outer wall of the cubicle has a pair of sliding balcony doors, of a size such that their removal leaves an opening for installation of the module into the cubicle.

Plumbing and electrical lines are already installed in the cubicle, adjacent to the inner wall and the side wall away from the hall door. The bathroom module contains a lavatory, bathtub and water closet, and has plumbing connections to match the lines along the cubicle walls. An alternate kitchen module contains a stove, an oven and a sink, and also has plumbing to match the cubicle connections.

Figure 1:
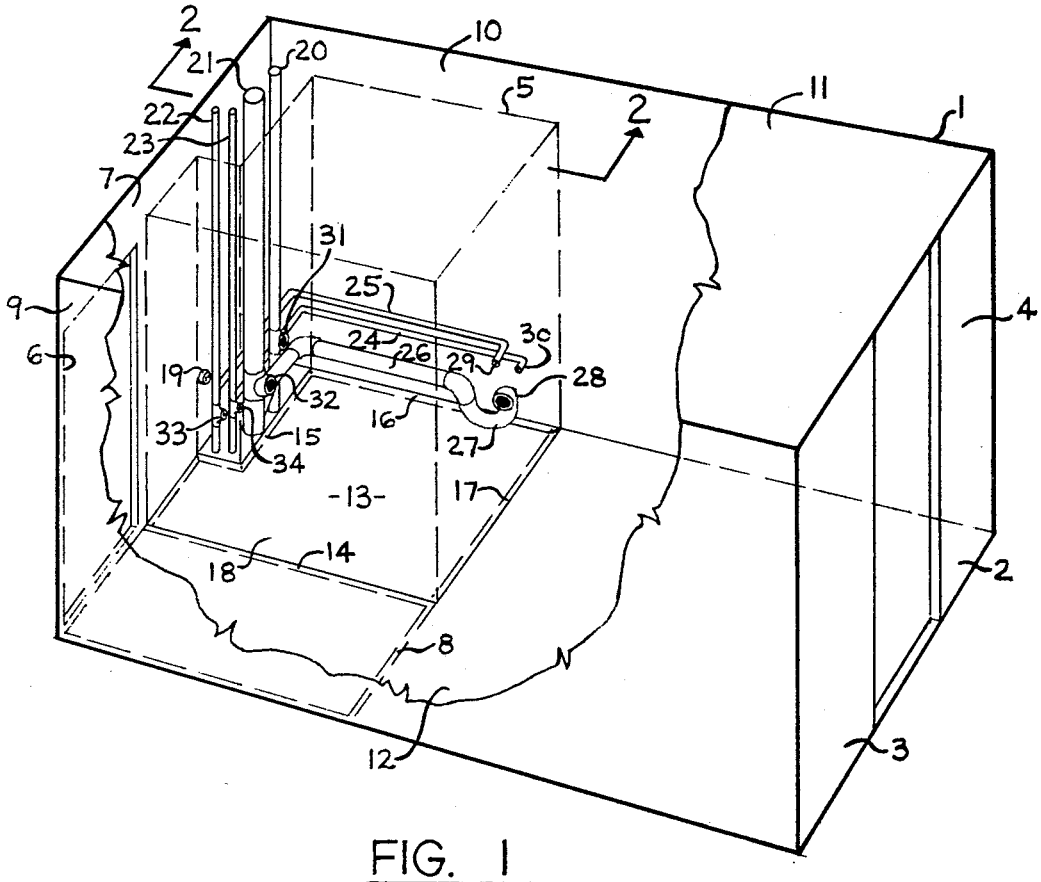
FIG. 1 is an isometric view of the cubicle, broken away to show a typical interior module in phantom.

Referring now to FIG. 1, prefabricated cubicle 1 is shown broken away to reveal the details of the fixed plumbing lines. A pair of sliding doors 2 will be seen in outer wall 3, and can be removed to provide open area 4 for the passage of interior bathroom module 5 therethrough. Module 5 is shown in phantom so the fixed plumbing can be seen clearly. Hall door 6 is shown in inner cubicle wall 7, and removable floor section 8 lies adjacent thereto. Cubicle side walls 9 and 10, ceiling 11 and floor 12 make up the rest of cubicle 1. Recess 13 in floor 12 has edges 14, 15, 16 and 17 bevelled at about 60° to the vertical to match the edges of module floor 18, better seen in FIG. 2.

Electrical outlet 19 is attached to inner cubicle wall 7, and sections of four plumbing lines are adjacent thereto, adapted to connect to floors above and below the cubicle shown. Vent line 20, waste line 21, hot water line 22 and cold water line 23 run vertically as shown. Cold water extension 24, hot water extension 25 and waste extension 26 are installed adjacent to side wall 10, with extension 26 including trap 27, and ending with connector 28. Hot water extension 25 ends with connector 29, and cold water extension 24 ends with connector 30. Vent line 20, waste line 21, hot water line 22 and cold water line 23 have connecting tees 31, 32, 33 and 34 respectively.

Figure 2:
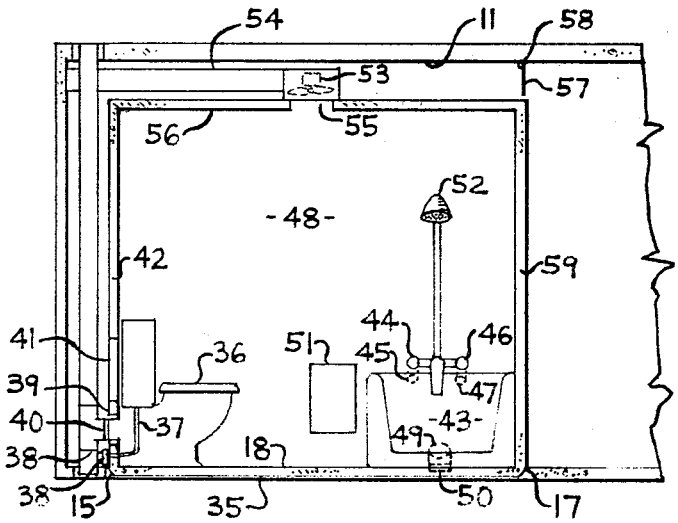
FIG. 2 is a sectional view taken along lines 2—2 in FIG. 1, showing a bathroom module installed in the cubicle.

The sectional view of bathroom module 5 in FIG. 2 shows module floor 18 resting on bevelled edges 15 and 17 of cubicle floor 12. Recess 13 may or may not contain membrane 35. Water closet 36 has cold water line 37 ending in connector 38, and waste line 39 ending in connector 40. Cold water connector 38 is shown fastened to tee 34, and waste connector 40 is fastened to tee 32. Panel 41 can be removed from inner module wall 42 for access to plumbing lines from the interior of module 5. Bathtub 43 has hot water line 44 with end connector 45, and cold water line 46 with end connector 47 penetrating module side wall 48. Waste line 49 has connector 50 on the lower end, and panel 51 is removable for access to the lines along cubicle side wall 10. Shower head 52 is also shown connected to water lines 44 and 46. Cubicle ceiling 11 has ventilation fan 53 and exhaust duct 54 adjacent thereto, aligned with opening 55 in module ceiling 56. Fan 53 remains in place during installation of module 5 without impeding the installation. Flap 57 is shown attached to cubicle ceiling 11 by hinge 58, aligned with outer wall 59 of module 5 and of sufficient height to fill the gap above module ceiling 56.

Figure 3:
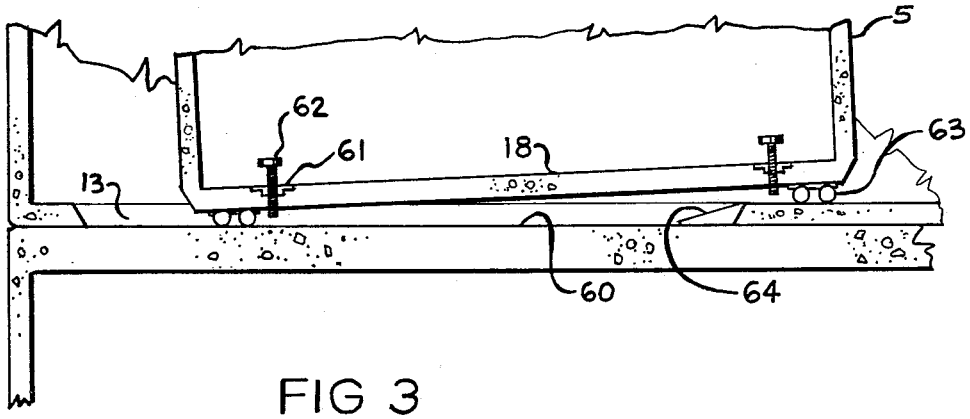
FIG. 3 is a similar sectional view, but showing the lower portion of a module during the installation process.

Turning now to FIG. 3, which is similar to the sectional view seen in FIG. 2, interior module 5 is shown partially removed from cubicle recess 13. Concrete floor 60 is actually part of the cubicle below, and supports the cubicle which is herein described in detail. Module floor 18 can be seen to contain several threaded attachments 61. Long bolts 62 have been installed, and extended to contact concrete floor 60, raising module 5 sufficiently above module floor 18 to allow the installation of low-profile roller assemblies 63. When bolts 62 are then retracted as shown, entire module 5 can be rolled out of recess 13. All plumbing lines have been disconnected by the time this is done, and ramp 64 has been placed along bevelled edge 17 to help rollers 63 climb out of recess 13.

Figure 4:
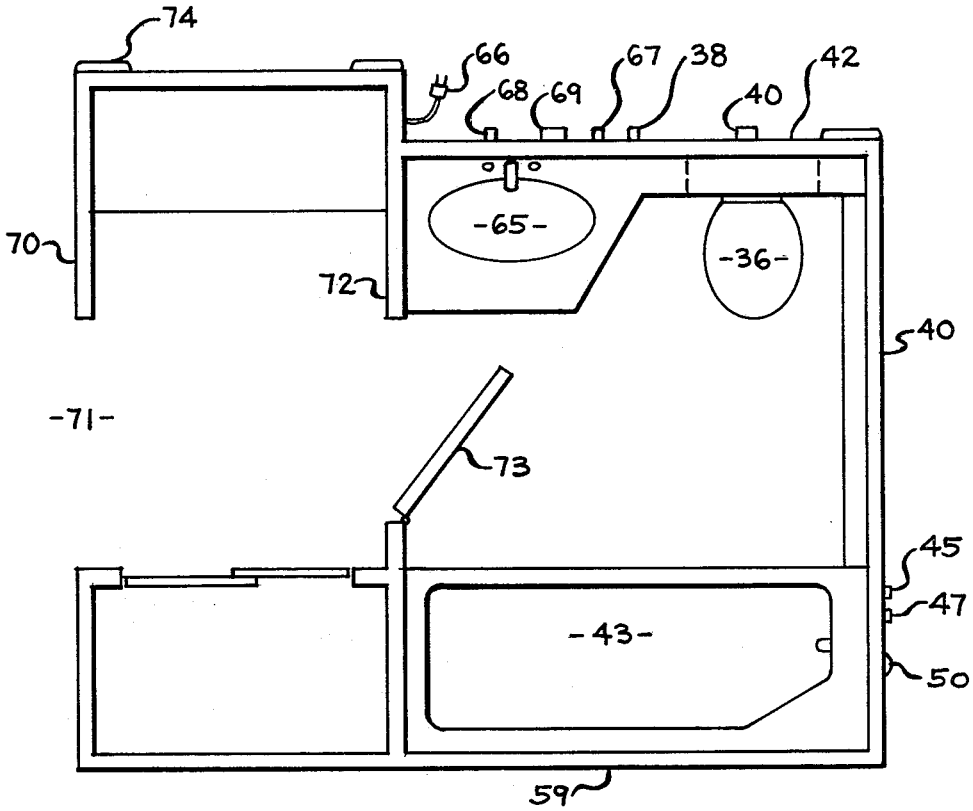
FIG. 4 is a plan view of a bathroom module, with ceiling removed.

FIG. 4 shows a plan view of bathroom module 5 as installed in cubicle 1. In a typical arrangement, lavatory 65 and water closet 36 are located adjacent to inner module wall 42. Cold water connector 38 attaches to tee 34, and waste connector 40 attaches to waste line 21 below tee 32. Electrical line 66 connects to outlet 19, lavatory cold water connector 67 mates with tee 34, hot water connector 68 mates with tee 33 and waste connector 69 attaches to tee 32. Bathtub 43 has waste connectors 28 and 50 mating, hot water connectors 29 and 45 mating and cold water connectors 30 and 47 mating. Module side wall 70 contains opening 71, and center wall 72 mounts door 73 to separate the powder room portion from the bathroom fixture portion of the module. Compressible seals 74 provide fireproofing isolation of the module.

Figure 5:
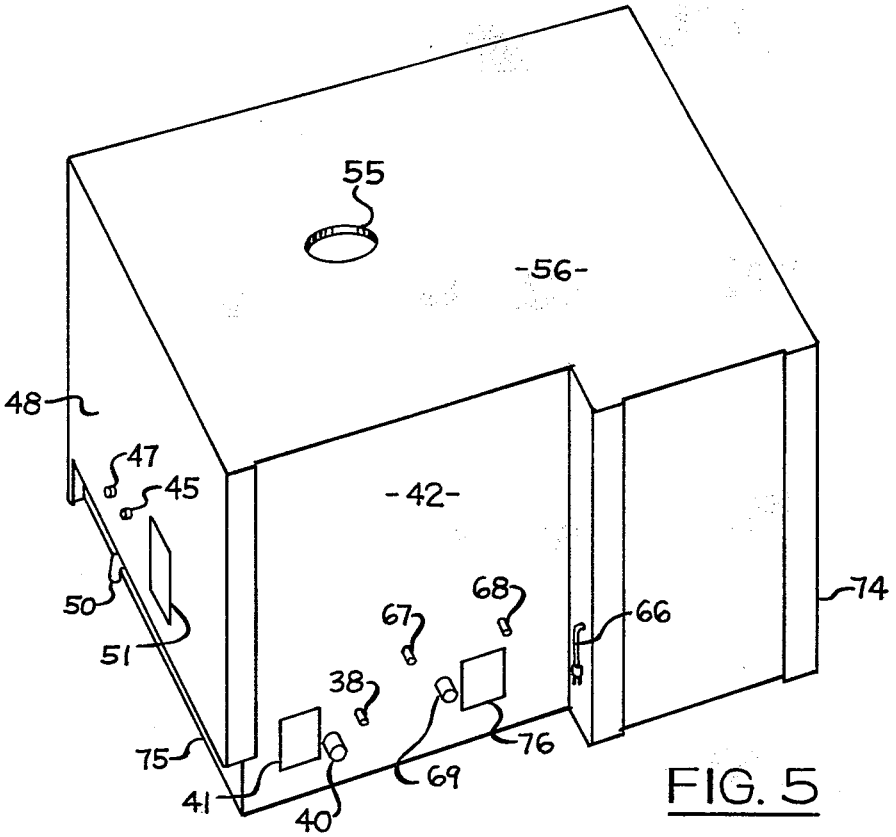
FIG. 5 is an isometric view of a bathroom module, taken from the sides toward the cubicle wall.

FIG. 5 shows an external view of module wall 42 and side wall 48. Opening 55 is seen in module ceiling 56, and seals 74 are in place on wall 42. Bathtub connectors are shown penetrating wall 48, with 45 for hot water, 47 for cold water and 50 for waste connection. Lower section 75 of wall 42 is indented to allow space for waste trap 27. Panel 51 is removable for access to plumbing outside wall 48, and panels 41 and 76 provide access to lines outside wall 42. Water closet connector 38 is for cold water and connector 40 goes to waste line 21. Lavatory connector 68 is for hot water, connector 67 is for cold water, and connector 69 goes to waste tee 32. Electrical line 66 is also shown.

Figure 6:
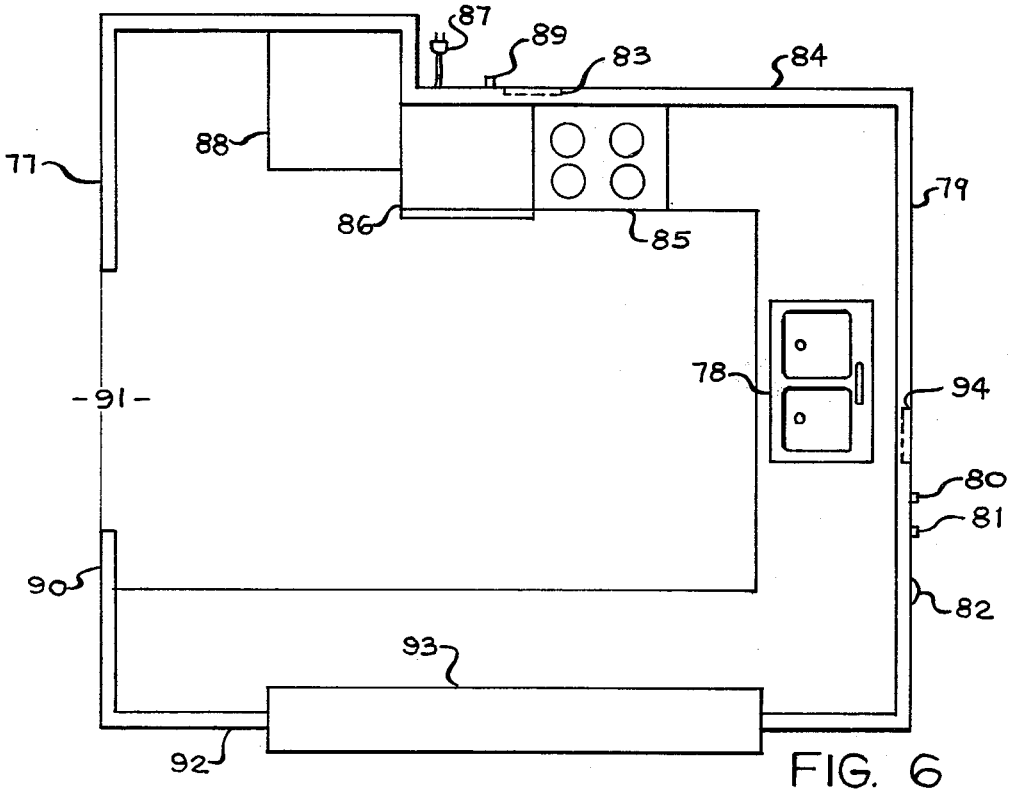
FIG. 6 is a plan view of a kitchen module, with ceiling removed.

A plan view of alternate kitchen module 77 is shown in FIG. 6 as the same size as bathroom module 5. The same plumbing and electrical connections can be used as follows: Sink 78 has connectors penetrating side module wall 79, with 80 for hot water, 81 for cold water and 82 for waste connection. Panel 83 is removable for access to plumbing outside inner module wall 84 and panel 94 provides access to plumbing outside wall 79. Stove 85 and oven 86 have hot air exhausted by fan 53 and duct 54 attached to cubicle 1. Electrical line 87 connects to electrical outlet 19 on cubicle 1, and also provides power for refrigerator 88. Cold water connector 89 is used if refrigerator 88 contains an ice-maker. Side wall 90 includes doorway 91 and outer wall 92 may have a counter 93 with its attendant pass-through area. Shelves and cabinets exist in the upper section of module 77, but are not shown.

As previously mentioned, a kitchen module may be substantially wider than the one shown in FIG. 6, in which case a common wall is removed and an adjacent cubicle is included to form a larger room area. The module then has space to turn sidewise for passage through the openable area in the outer cubicle wall.

While my invention has been described in great detail in terms of one embodiment, it should be understood that various changes can be made without departing from its spirit. It is therefore intended that the invention be limited only by the scope of the following claims.

We claim:

1. A prefabricated building cubicle adapted to receive an interior module, said cubicle comprising: a floor, a ceiling and four walls, said floor having a portion thereof recessed to receive said interior module and to align with the floor of said module, at least one of said walls having plumbing and electrical lines adjacent thereto, said plumbing lines being adapted for connection with said interior module, and another of said walls having an openable area therein, said openable area being of sufficient size to allow passage of said module therethrough.

2. The prefabricated circle according to claim 1, further including an interior prefabricated module having a floor, a ceiling and four walls, said module resting in the recessed portion of the floor of said cubicle, the floor of said module aligning substantially with said cubicle floor, said plumbing lines of said cubicle being connected to said module.

3. Claim 1, wherein said cubicle ceiling has a ventilation fan and exhaust duct adjacent thereto, said fan and duct being so located as to align with an opening in said module without impeding the installation of said module.

4. Claim 2, wherein the floor of said interior module contains a plurality of internally-threaded attachments, said attachments being adapted to cooperate with bolts inserted therein to elevate said floor above the floor of said prefabricated cubicle.

5. Claim 2, further including flaps hingedly attached to said cubicle ceiling, said flaps being aligned with two of said module walls and of sufficient height to substantially fill the gap above said module ceiling.

6. Claim 2, wherein said interior module includes a lavatory, bathtub and water closet.

7. Claim 2, wherein said interior module includes a stove, an oven and a sink.

8. A method of installing a prefabricated interior module into a prefabricated building cubicle comprising the steps of:

opening an area in one wall of said cubicle, pushing said interior module partially thru said open area, applying low-profile roller assemblies to the bottom surface of said module, pushing said module completely inside said cubicle, applying additional roller assemblies under said module, rolling said module into a recess in the floor of said cubicle, installing long bolts into a plurality of internally-threaded attachments on the floor of said module, extending said bolts to further elevate said floor above the recessed floor of said cubicle, removing said roller assemblies from under said module floor, lowering said module into position in said cubicle recess by removing said long bolts from said attachments, and connecting the cubicle plumbing lines to said module.

9. A method of removing a prefabricated interior module from a prefabricated building cubicle comprising the steps of:

disconnecting the cubicle plumbing lines from said module, installing long bolts into a plurality of internally-threaded attachments on the floor of said module, extending said bolts to elevate said floor above the recessed floor of said cubicle, applying low-profile roller assemblies to the bottom surface of said module, retracting said bolts from contact with said cubicle floor, opening an area in one wall of said cubicle, rolling said module out of the recess in the floor of said cubicle, and pushing said module completely thru said open area.

* * * * *